United States Patent [19]

Jester

[11] Patent Number: 4,514,789

[45] Date of Patent: Apr. 30, 1985

[54] ILLUMINATED LIGHT SWITCH PLATE WITH LED AND OSCILLATOR CIRCUIT

[76] Inventor: Michael H. Jester, 11626 Vaca Pl., San Diego, Calif. 92124

[21] Appl. No.: 587,049

[22] Filed: Mar. 7, 1984

[51] Int. Cl.[3] ..... F21V 33/00

[52] U.S. Cl. ..... 362/95; 362/200; 362/276; 362/20; 200/310

[58] Field of Search ..... 200/310, 312, 317; 362/95, 186, 200, 20, 276

[56] References Cited

U.S. PATENT DOCUMENTS

| | | | |
|---|---|---|---|
| 2,839,670 | 6/1958 | Gladstone | 240/2 |
| 3,265,888 | 8/1966 | Adolphson, Jr. | 240/73 |
| 3,348,221 | 10/1967 | Duffield | 340/381 |
| 3,435,169 | 3/1969 | Bienwald et al. | 200/167 |
| 3,588,489 | 6/1971 | Gaines | 240/2 |
| 3,626,171 | 12/1971 | Abramowitz et al. | 240/2 |
| 3,739,226 | 6/1973 | Seiter et al. | 362/20 X |
| 3,864,561 | 2/1975 | Spira et al. | 240/2 SP |
| 3,885,116 | 5/1975 | Kodaira | 200/308 |
| 3,895,225 | 7/1975 | Prior | 240/2 SP |
| 3,968,356 | 7/1976 | Martin | 240/2 S |
| 4,177,408 | 12/1979 | Mason | 315/362 |
| 4,211,955 | 7/1980 | Ray | 362/800 X |
| 4,255,780 | 3/1981 | Sakellaris | 362/32 |
| 4,441,143 | 4/1984 | Richardson, Jr. | 362/20 X |

OTHER PUBLICATIONS

National Semiconductor Linear Applications Handbook, No. 3, pp. AN154–1 to AN154–3, by P. Lefferts, Dec. 1975.

*Primary Examiner*—Peter A. Nelson

[57] ABSTRACT

A light switch plate having a rearwardly opening housing for removably holding an AA battery is detachably mountable over a conventional wall mounted 110 volt AC light switch. An LED mounted on the front of the housing is connected to the battery through an integrated circuit oscillator which flashes the LED. A phototransistor is also mounted on the front of the housing and is connected in the circuit for disabling the flashing of the LED except when the room is dark. The flashing LED provides an eye catching signal so that a person can more readily locate the light switch in the dark. The circuit has extremely lower current drain on the battery permitting operation for a year without requiring battery replacement.

10 Claims, 5 Drawing Figures

ILLUMINATED LIGHT SWITCH PLATE WITH LED AND OSCILLATOR CIRCUIT

BACKGROUND OF THE INVENTION

A person entering a dark room frequently has difficulty locating the wall mounted light switch. If the room is very dark, the person often must grope around in an effort to locate the switch by feeling along the wall. As a result, the wall ends up being soiled from dirty hands. Since the person cannot see where he or she is going, the person can accidentally walk into walls, furniture, hanging light fixtures and the like, sometimes damaging the same or even causing personal injury.

Devices are commercially available for solving the foregoing problem. One such device comprises a light switch having an actuator lever with a lamp inside. Another such device comprises a light switch having a small illuminating source mounted in the center of an ON/OFF rocker arm. The illuminating device is only energized when the light switch rocker arm is in its OFF position.

Each of the foregoing devices are substitutes for the existing conventional wall mounted light switch. Their installation involves disconnection of the old light switch from the 110 volt AC wires in the wall socket and reconnection of the new device. This is a time consuming and potentially dangerous operation for homeowners and other non-electricians. Improper connection of the 110 volt AC wires can lead to hazardous shorts. These prior devices utilize incandescent light sources which may give off excessive heat and are prone to burnout and other faults.

SUMMARY OF THE INVENTION

It is therefore the primary object of the present invention to provide an illuminated apparatus for enabling a person to readily locate a wall mounted light switch when entering a dark room.

Another object of the present invention is to provide such an illuminated apparatus which does not require removal and replacement of the existing wall mounted light switch.

Another object of the present invention is to provide such an illuminated apparatus which is readily installed and does not require connection to the 110 volt AC wires in the light switch wall socket.

Another object of the present invention is to provide such an illuminated apparatus which automatically emits light when the room is dark and ceases emitting light when the room is well lit.

Another object of the present invention is to provide such an illuminated apparatus which flashes in the dark to provide a more eye catching signal.

Another object of the present invention is to provide such an illuminated apparatus which is durable and inexpensive.

The illustrated embodiment of my invention includes a light switch plate having a receptacle for removably holding a battery. The light switch plate is installed over a conventional wall mounted light switch. An LED is mounted on the switch plate and is connected to the battery through an oscillator which flashes the LED. A photo transistor in the circuit disenables the flashing of the LED except when the room is dark.

DESCRIPTION OF THE PREFERRED EMBODIMENT

Figure 1:
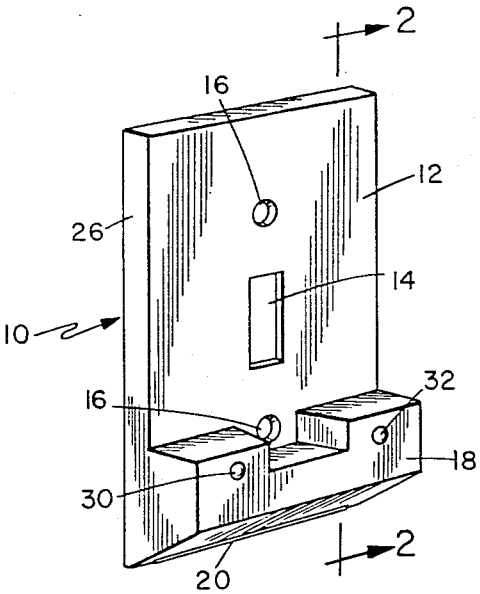
FIG. 1 is a perspective view of the preferred embodiment of my invention.

Referring to FIG. 1, the preferred embodiment 10 of my invention includes a rectangular plate 12 configured to be detachably secured to a conventional wall mounted electrical light switch (not illustrated). The light switch is typically located adjacent the entry way of a room and is connected by wires to 110 volts AC. The plate 12 has an aperture or slot 14 in the medial portion thereof for receiving therethrough the actuator lever of the light switch (not illustrated). The plate 12 further has a pair of holes 16 through which mounting screws (not illustrated) extend, for threading into the underlying light switch.

Figure 2:
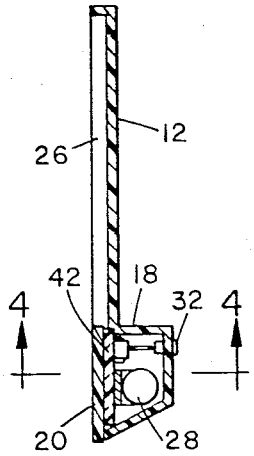
FIG. 2 is a vertical sectional view of the preferred embodiment taken along line 2—2 of FIG. 1.
Figure 4:
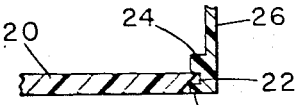
FIG. 4 is an enlarged, fragmentary sectional view taken along line 4—4 of FIG. 2 illustrating the sliding fit of the removable door on the rear side of the switch plate.

The illustrated embodiment of my invention further includes a housing 18 (FIG. 1) which projects outwardly from the front side of the plate 12 and extends across the width of the plate at the lower end thereof. The housing 18 is integrally formed with the plate 12 and opens on the rear side of the plate as illustrated in FIG. 2. A rectangular door 20 (FIG. 2) is removably mounted to the plate for opening and closing the housing. As illustrated in FIG. 4, the side edges of the door are formed with rails 22 which slide in tracks defined by parallel inward flanges 24 formed in the lower portions of the side edges 26 of the plate 12. The lower end edge of the plate has a slot for permitting the door 20 to be removed by sliding it downwardly. The door and plate may have an engaging slot and detent arrangement molded therein (not illustrated) to provide a mechanism for locking the door in its closed position. The rear face of the door may have ribs molded therein to facilitate sliding the door with a person's index finger.

The housing 18 (FIG. 1) is dimensioned and configured to completely enclose the electronic circuitry of my invention which is hereafter described. The width, height, and placement of the housing are designed to minimize any obstruction to a person's index finger flicking the light switch actuator lever. Thus, the housing preferably extends only as high as the lower screw hole 16. The housing has a generally U-shaped outline to extend around the lower screw hole 16.

The plate 12 and housing 18 are preferably integrally molded of a heat resistant plastic to minimize any danger of combustion in the event of an electrical short in the underlying light switch. The door 20 is also preferably molded of the same heat resistant plastic. It provides complete electrical insulation between the underlying light switch and 110 volt AC wires on the one hand and the electronic components within the housing on the other hand.

The housing 18 encloses an elongate cylindrical battery 28 (FIG. 2) which extends horizontally across the lower end of the plate 12. The battery is preferably a 1.5 volt AA size cell which is capable of providing sufficient electric power storage for long term operation of the functions hereafter described. The use of a battery makes the device completely self-contained and eliminates any need to make connection to the 110 volt AC wires in the light switch wall socket. Thus, the illustrated embodiment of my invention may be readily installed merely by replacing the existing light switch plate and using the same mounting screws. The risk of electric shock or shorting is not encountered.

An LED 30 and a phototransistor 32 (FIG. 1) are mounted in corresponding holes formed in the opposite sides of the front face of the housing 18. It is highly desirable to have a means for illuminating the switch plate for a long period of time without having to remove the device from the wall to replace the battery 28. An incandescent lamp would drain an AA size battery in a relatively short time. Therefore, the LED 30 is utilized because its solid state construction results in a very low power drain when illuminated.

Figure 5:
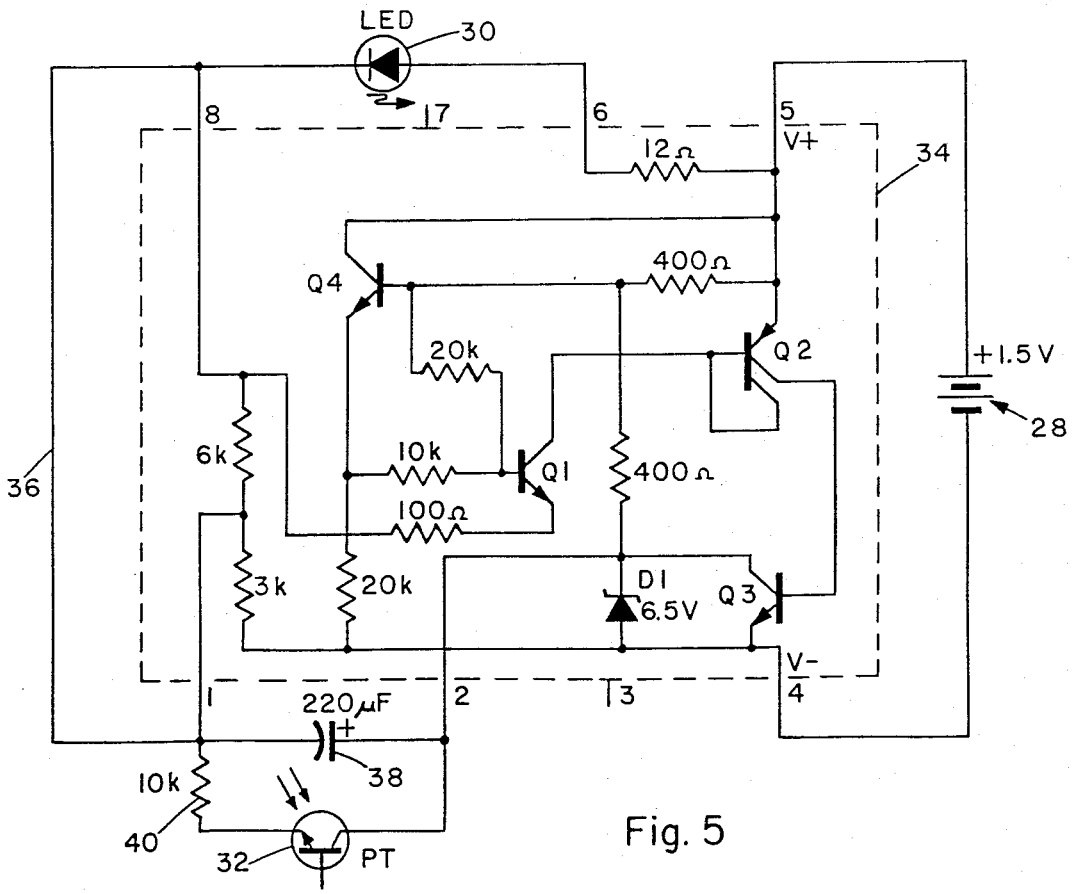
FIG. 5 is a schematic diagram of the electronic circuit of the preferred embodiment.

Commercially available LEDs typically will not light from a 1.5 volt battery and will drain the common 9 volt battery in a few hours. My invention includes means for generating sufficient voltage to flash the LED 30 from the single 1.5 volt AA size battery 28. An oscillator circuit depicted in FIG. 5 is connected to the LED 30 and the battery 28. The oscillator circuit in the illustrated embodiment of my invention includes an LM3909 monolithic integrated circuit 34 which contains the linear circuit surrounded by the dashed line rectangle in FIG. 5. This LM3909 integrated circuit is housed within a dual-in-line package having pins 1–8 and is commercially available from National Semiconductor Corporation of Santa Clara, California.

The LED 30 (FIG. 5) is preferrably a subminiature green light emitting diode with a forward voltage of 2.1 volts at 20 mA. Such an LED is available as Cat. No. 276-037 from RADIO SHACK Division of Tandy Corporation, Fort Worth, Texas.

The LED 30 is connected between pins 6 and 8 of the LM3909 integrated circuit as illustrated in FIG. 5. The plus and minus terminals of the 1.5 volt AA size battery are connected between pins 5 and 4, respectively, of the LM3909 device. Pins 1 and 8 of the LM3909 are connected together through a lead 36. A single capacitor 38 is connected between pins 1 and 2 of the LM3909 and provides both timing and voltage boosting. The capacitor 38 is preferrably of the electrolytic type rated at 220 microfarads at 16 volts which causes the LED 30 to flash approximately forty-five times per minute. The circuit described has minimum power drain on the battery. Operated without the phototransistor 32 and 10k resistor 40 connected as illustrated, the LED 30 receives power only about 1% of the time where capacitor 38 is rated at 300 microfarads. The rest of the time, all transistors but Q4 are off. The 20k resistor from Q4's emitter to supply-common draws only about fifty microamperes. The capacitor is charged through the two 400 ohm resistors connected to pin 5 and through the 3k resistor connected to pin 4.

Transistors Q1 through Q3 remain off until the capacitor becomes charged to about 1 volt. This voltage is determined by the junction drop of Q4, its base-emitter voltage divider, and the junction drop of Q1. When the voltage at pin 1 becomes a volt more negative than that at pin 5 (the supply positive terminal), Q1 begins to conduct. This then turns on Q2 and Q3.

The LM3909 then supplies a pulse of high current to the LED. The current amplification of Q2 and Q3 is between 200 and 1000. Q3 can handle over 100 mA and rapidly pulls pin 2 close to supply common (pin 4). Since the capacitor is charged, its other terminal at pin 1 goes below the supply common. The voltage at the LED is then higher than battery voltage, and the 12 ohm resistor between pins 5 and 6 limits the LED current.

The flashing LED provides an eye catching signal that greatly facilitates location of the light switch actuator lever in the dark. Flashing of the LED in this fashion also greatly lengthens battery life. For example, three month continuous flasher operation is achieved with a standard 1.5 volt AA battery. Six month continuous flasher operation is achieved with a 1.5 volt AA alkaline battery. Battery cell sizes larger than AA, such as, C or D sizes, achieve much longer flash rates, but they are not preferred because they require a much larger housing 18 (FIG. 1) which would obstruct manual operation of the light switch actuator lever.

A continuously appearing illuminated LED can also be provided with the LM3909 and 1.5 volt AA battery. This is done by increasing the duty cycle and frequency of the current pulses to the LED until the average energy supplied provides sufficient light. Capacitor 38 is made to be 2 microfarads at 3 volts, resulting in an operating frequency well above 2KHz. However, this illumination is not long lasting since battery drain is about 12 mA.

Low rate flashing operation using the 220 microfarad capacitor (e.g., approximately forty-five flashes per minute) can be greatly extended by providing the circuit with a means for enabling the flashing only when the level of ambient light striking the plate falls below a predetermined level. In other words, by automatically causing the LED 30 to flash only in the dark, a light switch locating signal can be providing for as long as a year when the battery is a 1.5 volt alkaline cell. Many rooms are well lighted either by sunlight or 110 volt AC room lamps at least twelve hours per day. Thus, the LED need only flash half, or as little as a third of each day.

The automatic flash enabling and disabling means is provided in the illustrated embodiment by connecting the emitter and collector of the phototransistor 32 (FIG. 5) to the negative and positive terminals, respectively, of the capacitor 38. The base of the phototransistor is left unconnected. The emitter of the phototransistor is connected to the negative terminal of the capacitor through the 10k resistor 40. When the level of ambient light striking the plate 12 and the phototransistor 32 falls below a first predetermined level, the phototransistor turns off and the LED flashes. When the level of ambient light striking the plate and the phototransistor rises above a second predetermined level, the phototransistor turns on. This results in a short across the capacitor and disables flashing of the LED. The 10k resistor 40 then limits current drain on the battery through the 3k resistor connected inside the LM3909 to pin 1. One suitable phototransistor is the Cat. No. 276-130 silicon phototransistor from RADIO SHACK having a maximum collector current of 25 mA and a Typ. 2.0 nA collector dark current. Alternate connection of the phototransistor or some other light sensitive switching arrangement may be desirable.

Figure 3:
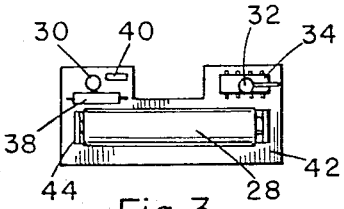
FIG. 3 is a plan view of the PC board utilized in the preferred embodiment to mount and interconnect the electronic components and battery within the housing with extends across the bottom of the switch plate.

FIG. 3 illustrates a PC board 42 having a generally U-shaped outline which fits within the housing 18 and serves as a carrier and electrical interconnection means for the electronic components of the preferred embodiment of my invention. The PC board 42 has a generally U-shaped outline which conforms to that of the housing 18. The PC board 40 may be of conventional construction and may be fabricated of one-sided copper clad FR-4 epoxy glass bonded laminate etched to delineate the desired conductive pattern. The leads of the LM3909 integrated circuit 34, the capacitor 38, the LED 30, the phototransistor 32 and the resistor 40 are inserted through holes in the PC board in the general arrangement illustrated in FIG. 3. The leads are soldered to the etched copper conductive pattern to electrically interconnect them according to the schematic diagram of FIG. 5. Also attached to the PC board is AA battery holding means in the form of a conventional plastic battery holder 44 (FIG. 3) for removably holding the battery. The battery holder has terminals at each end for contacting the ends of the AA battery. The terminals are also connected to leads (not illustrated) which are received in holes in the PC board 42 and soldered to the conductive pattern to electrically interconnect the battery according to the schematic diagram of FIG. 5. One suitable battery holder is the Cat. No. 270-401 Penlight Battery Holder commercially available from RADIO SHACK.

The PC board 42 and attached components are inserted into the rear opening of the housing 18 as illustrated in FIG. 2. The PC board abuts the upper wall of the housing and the door 20 may be slid to its closed position to hold the PC board rigidly in place. The LED 30 and phototransistor 32 are soldered to the PC board with their leads left long enough so that the light emitting the light sensitive ends can be guided into the holes in the front surface of the housing 18 when the PC board is inserted.

Having described in detail a preferred embodiment of my illuminated light switch plate, it should be apparent that modifications and adaptations will occur to those skilled in the art. For example, the length of the plate may be extended to place the housing 18 further below the lower screw hole 16 to thereby further minimize the possibility of obstructing finger tip flicking of the light switch actuator lever. The circuitry could be packaged in a separate plate and housing for overlying attachment to the existing switch plate. Therefore, the protection afforded my invention should only be limited in accordance with the scope of the following claims.

I claim:

1. An apparatus for aiding a person in locating a conventional wall mounted light switch in the dark, comprising:

a generally planar switch plate configured to be removably secured over the light switch and having an aperture in the medial portion thereof for receiving therethrough an actuator of the light switch;

a housing connected to the switch plate for positioning on the exterior side of the wall when the switch plate is secured over the light switch;

means mounted within the housing for removably holding a battery and for establishing electrical connection with a positive terminal and a negative terminal of the battery when inserted;

an LED mounted in the housing so as to be visible externally of the housing;

a solid state oscillator mounted within the housing;

a capacitor mounted within the housing; and means for electrically interconnecting the LED, the battery holding means, the solid state oscillator and the capacitor independent of the light switch so that when the battery is inserted into the battery holding means the LED will flash to provide an eye catching signal for at least three months before the battery is substantially drained of its stored energy.

2. An apparatus according to claim 1 and further comprising:

light sensitive switch means mounted to the exterior of the housing and connected to the electrical interconnection means for disabling the flashing of the LED when the level of ambient light received by the light sensitive switch means is above a first predetermined level and for enabling the flashing of the LED when the level of ambient light received by the light sensitive switch means is below a second predetermined level.

3. An apparatus according to claim 1 wherein the battery, LED, oscillator and capacitor have electrical characteristics such that the LED will flash continuously for at least six months before the amount of stored electrical energy remaining in the battery is insufficient to flash the LED.

4. An apparatus according to claim 2 and further comprising a resistor connected to the electrical interconnection means and the light sensitive switch means so that less current is drained from the battery when the LED is not flashing than when it is flashing.

5. An apparatus according to claim 1 wherein the dimensions and attachment location of the housing relative to the switch plate are such that obstruction to a person's manual operation of the light switch actuator lever is minimized.

6. An apparatus according to claim 1 wherein the housing is integrally formed with the plate and the housing opens on a rear side of the plate.

7. An apparatus according to claim 1 wherein the housing extends across a bottom end of the plate.

8. An apparatus according to claim 1 wherein the solid state oscillator comprises an integrated circuit.

9. An apparatus according to claim 1 wherein the housing is generally rectangular and is dimensioned for receiving a single AA size battery and a circuit board which forms the interconnecting means.

10. An apparatus according to claim 6 wherein the housing includes a removable door for covering the rear opening of the housing.

* * * * *